US007041907B2

(12) United States Patent
Miyazaki

(10) Patent No.: US 7,041,907 B2
(45) Date of Patent: May 9, 2006

(54) SHIELDED WIRE HARNESS

(75) Inventor: Sho Miyazaki, Aichi (JP)

(73) Assignees: Autonetworks Technologies, Ltd., Mie (JP); Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 17 days.

(21) Appl. No.: 10/714,838

(22) Filed: Nov. 18, 2003

(65) Prior Publication Data

US 2004/0144557 A1 Jul. 29, 2004

(30) Foreign Application Priority Data

Nov. 21, 2002 (JP) ..... 2002-338284

(51) Int. Cl.
*H02G 1/00* (2006.01)

(52) U.S. Cl. ..... 174/72 A; 174/35 R; 439/610; 439/271; 439/274; 439/607; 439/609

(58) Field of Classification Search ..... 174/72 A, 174/35 R; 439/610, 271, 274, 607, 609
See application file for complete search history.

(56) References Cited

U.S. PATENT DOCUMENTS 5,304,067 A * 4/1994 Inaba et al. ..... 439/98
6,583,352 B2 * 6/2003 Fukushima et al. ..... 174/35 R
6,609,934 B2 * 8/2003 Chen et al. ..... 439/610

FOREIGN PATENT DOCUMENTS

JP A 11-26093 1/1999
JP 2002324627 A * 11/2002

* cited by examiner

*Primary Examiner*—Jinhee Lee
(74) *Attorney, Agent, or Firm*—Oliff & Berridge, PLC

(57) ABSTRACT

A plurality of wires are enclosed by a shielding member; and the shielding member is enclosed by a protecting member. The shielding member is connected to a shield case of equipment via a shield shell. The shielding member has a diameter-spread portion in which a diameter thereof is spread larger than that of the protecting member at an end portion where the shielding member is projected from the protecting member, and connected to the shield shell at an end edge thereof. The diameter-spread portion is covered by a covering member formed in tube shape.

6 Claims, 3 Drawing Sheets

SHIELDED WIRE HARNESS

BACKGROUND OF THE INVENTION

1. Field of the Invention

The present invention relates to a shielded wire harness.

2. Description of the Related Art

For connecting together two pieces of equipment such as an inverter unit and a motor in an electric vehicle, there is used a shielded wire harness. As a shielded wire harness of this type, there is known a shielded wire harness structured such that wire-side terminals are fixed to end portions of conductors of shielded wires, the wire-side terminals connected to equipment-side terminals disposed in a shield case of the equipment, and the shield layers of the shield wires are connected through connecting members to the shield case (see JP-A-11-026093).

However, in the shielded wire harness of the above described type, since an operation to insert the wire-side terminals into the shield case and an operation to connect the connecting members to the shield case must be repeated the same number of times as the number of terminal poles (that is, the number of shield wires), there is found a problem that it takes much time and labor.

Thus, there is proposed a shielded wire harness structured such that there are used wires having no shield layer, the wires are collectively covered with a flexible tube-shaped shielding member composed of braided wires, and wire-side terminals are fixed to the wires respectively. According to the shielded wire harness of the collective shield type, an operation to connect a shield function portion (shielding member) may be carried out only once, thereby being able to enhance the operation efficiency.

In the shielded wire harness of a collective shield type, as a member for protecting a shielding member composed of braided wires, there is employed a structure for placing a flexible bellows-shaped corrugated tube on the shielding member. In order to save the space for the wiring route of the wires, there is used a corrugated tube having a diameter as small as possible. Also, in correspondence to the fact that more than one wire-side terminals fixed to the end portions of the wires are arranged with a given pitch between them, the diameter of the end portion of the shielding member is spread and, in order to permit such spread of the diameter of the end portion of the shielding member, the end portion of the shielding member is exposed from the corrugated tube. Also, on the exposed portion of the shielding member, for protection thereof, there is wound adhesive tape substantially in a spiral manner, and further, in order to prevent the corrugated tube from shifting in the length direction thereof, the adhesive tape is wound up to the end portion of the corrugated tube.

However, since the braided wires constituting the shielding member are composed of metal fine lines braided into a net shape, the adhered areas between the respective metal fine lines and adhesive tape are relatively small, so that the adhesive power thereof becomes weak. Therefore, the adhesive tape wound on the exposed portion of the shielding member may become shifted or peeled off; and, in case where such occurs, it becomes impossible to protect the shielding member.

SUMMARY OF THE INVENTION

It is therefore an object of the invention to provide a shielded wire harness of a type structured such that a shielding member including braided wires is enclosed by a corrugated tube and the end portion of the shielding member is projected from the corrugated tube and is spread in diameter, wherein the diameter spread portion of the shielding member can be protected.

In order to achieve the object, according to one aspect of the invention, there is provided a shielded wire harness including: a plurality of wires; a plurality of wire-side terminals respectively connected to the plurality of wires and configured to be connected to respective terminals disposed within a shield case of an equipment; a shielding member configured to enclose the plurality of wires collectively; a protecting member configured to enclose the shielding member; and a shield shell configured to be connected to the shield case, wherein the shielding member includes a diameter-spread portion in which a diameter thereof is spread larger than that of the protecting member at an end portion where projected from the protecting member, and connected to the shield shell at an end edge thereof, wherein the shielded wire harness further includes a covering member formed in tube shape and configured to cover the diameter-spread portion.

BRIEF DESCRIPTION OF THE DRAWINGS

The objects and advantages of the present invention will become more apparent by describing a preferred embodiment thereof in detail with reference to the accompanying drawings, wherein.

DETAILED DESCRIPTION OF THE PREFERRED EMBODIMENTS

Referring now to the accompanying drawings, a description will be given in detail of a preferred embodiment of the invention.

Figure 1:
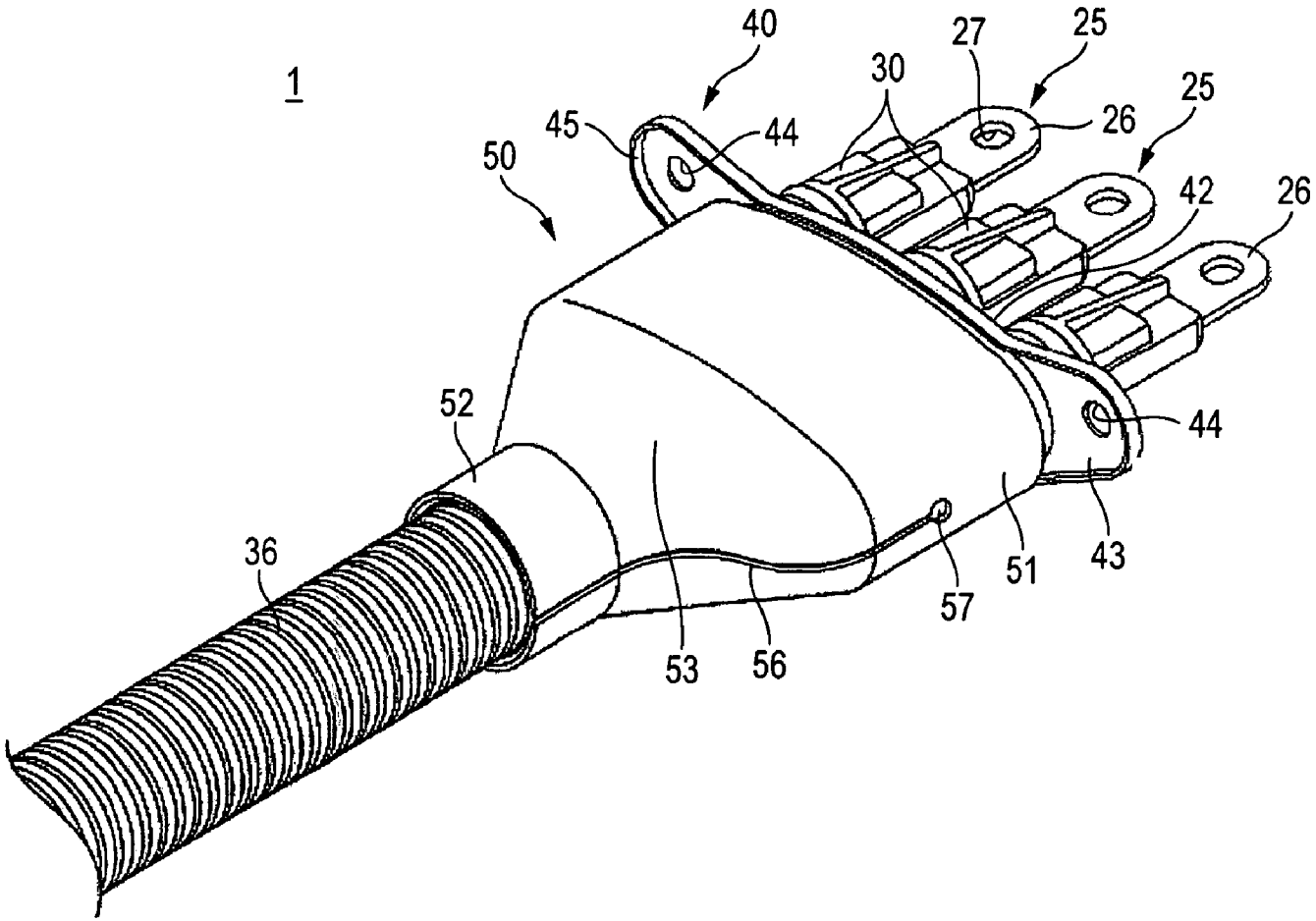
FIG. 1 is a perspective view of an embodiment of a shielded wire harness according to the invention.
Figure 2:
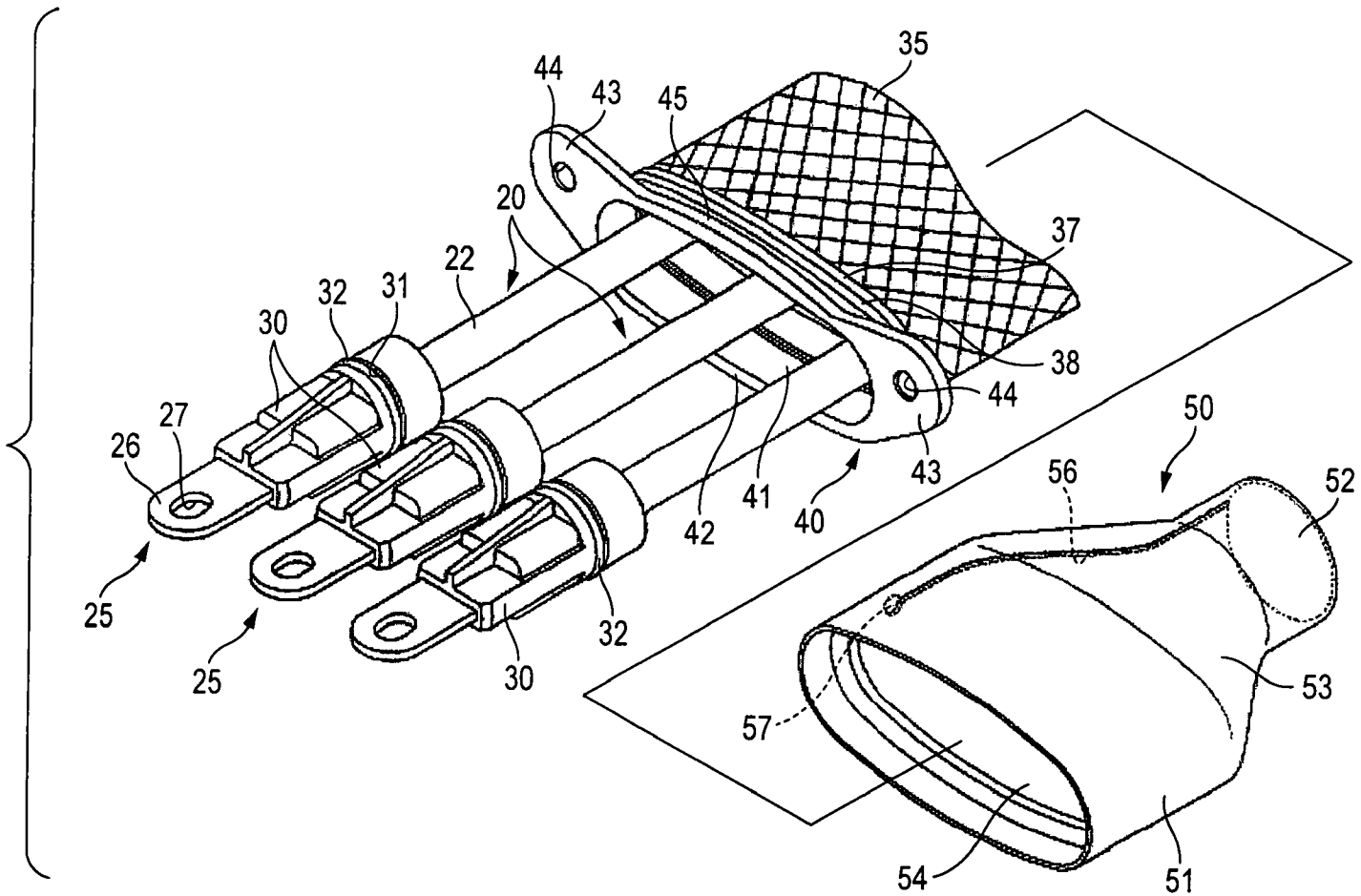
FIG. 2 is a perspective view of the shielded wire harness, with a cover removed from a shielding member.
Figure 3:
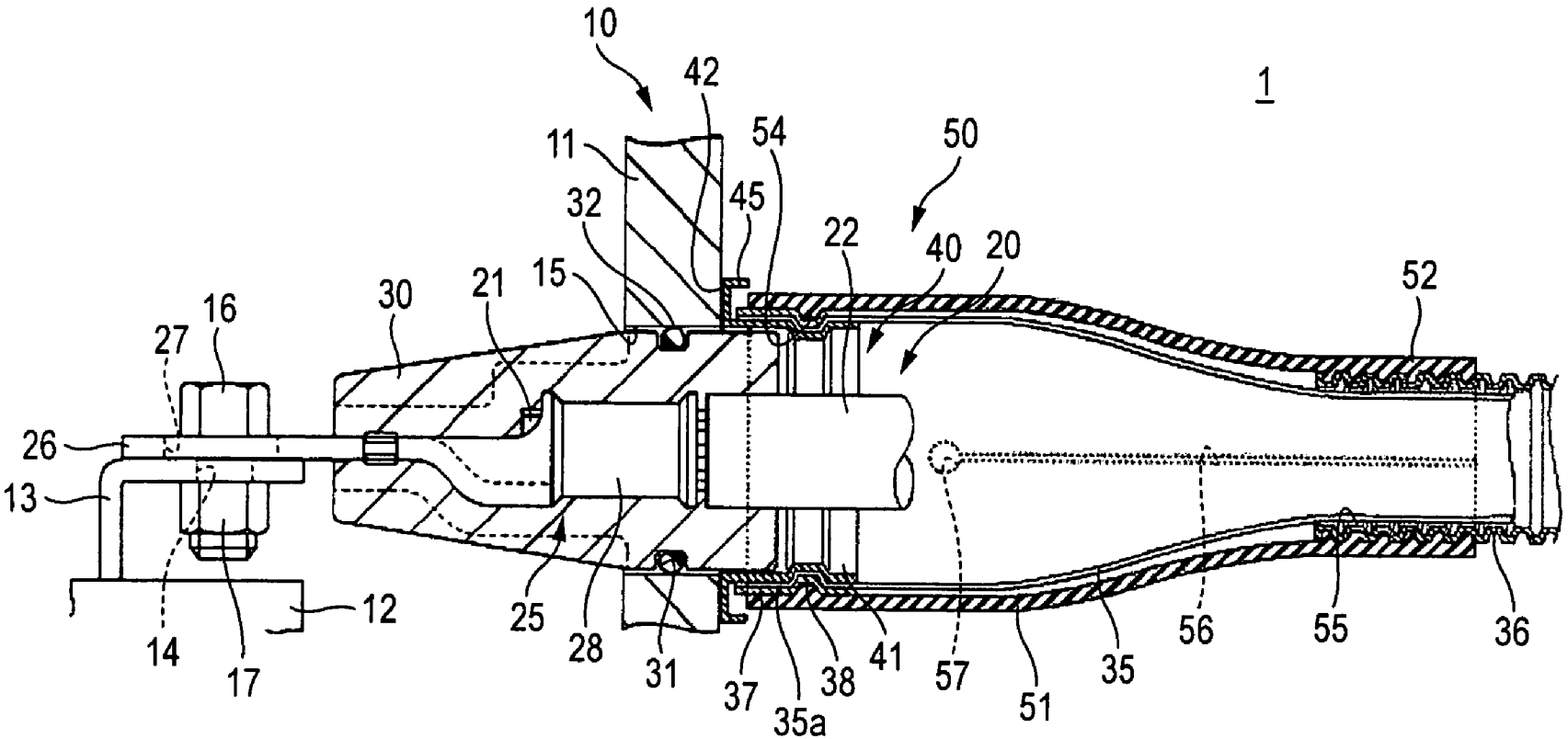
FIG. 3 is a section view of the shielded wire harness, showing a state in which the shielded wire harness is connected to equipment.

Now, description will be given below with reference to FIGS. 1 through 3 of an embodiment embodying the invention.

A shielded wire harness 1 according to the present embodiment is used for connecting together two pieces of equipments such as an inverter unit and a motor in an electric vehicle.

Equipment 10 is structured such that equipment main body 12 and three equipment-side terminals 13 extended from the equipment main body 12 are stored in a conductive shield case 11. Each of the equipment-side terminals 13 is formed as a plate referred to as a bus bar which is bent substantially in an L-like shape and, in the horizontal portion of the equipment-side terminal, there is formed a bolt hole 14 which penetrates in the vertical direction therethrough. In the side wall of the shield case 11, there are formed three circular-shaped mounting holes 15 side by side in such a manner that they correspond to the three equipment-side terminals 13 respectively.

Next, description will be given below of the shielded wire harness 1. The shielded wire harness 1 includes more than one wire 20, wire-side terminals 25, outer covering 30, a corrugated tube 36 (protecting member), a shield shell 40, and a cover 50 (covering member).

Each of the wires 20 is structured such that the outer periphery of a conductor 21 is covered with an insulation cover 22; and, differently from the shield wire, no shield layer is disposed in the wire 20. To the end portions of the respective wires 20, there are connected the wire-side terminals 25.

The substantially front half portion of each of the wire-side terminals 25 provides an equipment connecting portion 26 which is formed as a flat plate long in the back-and-forth direction and also in which a bolt hole 27 is formed, while the substantially rear half portion of each of the wire-side terminals 25 provides a so-called open-barrel-shaped wire connecting portion 28.

The outer covering 30 is formed by resin molding integrally with the wire-side terminal 25 in such a manner that it encloses the rear end portion of the equipment connecting portion 26 of the wire-side terminal 25, the whole of the wire connecting portion 28, and the front end portion of the insulation cover 22. From the front end face of the outer covering 30, there is projected the equipment connecting portion 26 of the wire-side terminal 25; and, from the rear end face thereof, there is introduced the portion of the wire 20 that is covered with the insulation cover 22. The outer periphery of the rear end portion of the outer covering 30 is formed as a circular portion concentric with the wire 20, and, in a seal groove 31 formed in the outer peripheral surface of the circular portion, there is mounted a sealing ring 32.

The shielding member 35 (bracket shield) is a tube-shaped member composed of a braided wire body formed by braiding metal fine lines into a mesh-like shape, while the shielding member 35 encloses the three wires 20 collectively. The shielding member 35 can be expanded and contracted not only in the diameter direction but also in the longitudinal direction due to the flexible property of the metal fine lines.

The corrugated tube 36 is made of synthetic resin in a tube shape having a large number of bellows portions continuously connected together. The corrugated tube 36, due to the above structure, is made elastically deformable. In an interior of the corrugated tube 36, there are inserted the three wires 20 all together, and the inside diameter of the corrugated tube 36 is set for a necessary and minimum dimension in order to be able to maintain the bundled state of the three wires 20 in a manner as bundling straw bags. Incidentally, over the entire length of the corrugated tube 36, there is formed a slit (not shown) along the longitudinal direction of the corrugated tube 36. Normally, the corrugated tube 36 keeps its tube-like shape in which the slit is closed due to the elastically restoring force of the corrugated tube 36.

The shield shell 40 is an integral body formed by deep drawing a metal plate member; and, the shield shell 40 includes a substantially elliptic-shaped tube portion 41 which is long in the lateral direction thereof as a whole, a plate-shaped flange portion 42 projecting outwardly over the entire periphery of the tube portion 41 from the front end edge thereof, and a pair of mounting portions 43 projecting obliquely outwardly in a flush manner from the two right and left end portions of the flange portion 42. The front surfaces of the flange portion 42 and mounting portions 43 are contacted with the outer wall surface of the shield case 11; and, in each of the mounting portions 43, there is formed a bolt hole 44 which corresponds to the female screw hole (not shown) of the shield case 11. Also, on the entire periphery of the shield shell 40, there is disposed a protect wall 45 which projects continuously and backwardly almost at right angles along the outer peripheral edges of the flange portion 42 and mounting portions 43.

The cover 50 is made of rubber and is formed in a tube shape as a whole. The front end portion of the cover 50 is formed as a substantially-elliptic-shaped large-diameter portion 51 which is similar in figure to the tube portion 41 of the shield shell 40, while the rear end portion of the cover 50 is formed as a circular-shaped small-diameter portion 52 similar to the corrugated tube 36. The large-diameter and small-diameter portions 51 and 52 are connected together through a tapered portion 53 which not only gradually spreads forwardly in the width direction thereof but also increases in diameter in the vertical direction thereof. In the inner periphery of the large-diameter portion 51, there is formed a large-diameter-side engaging portion 54 (an engaging portion) which is composed of a projecting strip extending in the peripheral direction of the large-diameter portion 51; and, in the inner periphery of the small-diameter portion 52, there is formed a small-diameter-side engaging portion 55 (an engaging portion) which is formed by continuously connecting together two or more peripheral-direction uneven portions in the axial direction of the small-diameter portion 52. Also, in the right side surface portion of the cover 50, there is formed a slit 56 narrowly and long in such a manner that it extends from the rear end of the cover 50 (the open edge of the small-diameter portion 52) through the taper portion 53 up to the large-diameter portion 51. The front end of the slit 56 does not reach the front end of the cover 50 but, in the back-and-forth direction, it is situated almost in the middle of the large-diameter portion 51; and, in the front end portion of the slit 56, there is formed a circular hole 57 which has a diameter larger than the width of the slit 56.

The terminal portion of the shielded wire harness 1 may be assembled in the following manner.

Firstly, the wire-side terminals 25 are respectively compression bonded to the end portions of the wires 20, while each of these wire-side terminals 25 and its associated outer covering 30 are united together into an integral body by molding. Also, the three wires 20 are previously inserted into the shielding member 35. The end portions of the wires 20 and wire-side terminals 25 are drawn out externally of the shielding member 35 and are spread in the right and left directions in such a manner that they are prevented from interfering with each other. And, the major parts of the respective wires 20 except for the end portions thereof are bundled together in a straw bag manner and, in this state, the corrugated tube 36 is mounted on the outer periphery of the shielding member 35. Since the inside diameter of the corrugated tube 36 is set for a dimension that allows the corrugated tube 36 to be substantially inscribed in the three wires 20 bundled in a manner bundling straw bags, the major parts of the wires 20 except for the end portions thereof can be maintained in close contacting state. The shielding member 35 is reduced in diameter so that the stitches of the braided wires can be prevented from opening and, at the same time, the shielding member 35 extends along the inner periphery of the corrugated tube 36.

The end portion of the shielding member 35 is exposed externally from the end portion of the corrugated tube 36. However, as described above, because the three wire-side terminals 25 are introduced out from the end portion of the corrugated tube 36 and are spread right and left, correspondingly to this, the end portion of the shielding member 35 is also spread greatly in the right and left directions and, at the same time, it is increased in diameter so as to be able to increase in the vertical dimension thereof, thereby providing a diameter-spread portion 35*a*.

The diameter-spread portion 35*a* of the end portion of the shielding member 35 is connected to the shield shell 40. To connect the diameter-spread portion 35*a* to the shield shell 40, the diameter-spread portion 35*a* is placed onto the tube portion 41 of the shield shell 40 from behind, a substantially-circular-shaped calking ring 37 is fitted with the outer peripheral side of the diameter-spread portion 35*a*, and the calking ring 37 is then calked. Due to the calking operation, the end portion of the diameter-spread portion 35*a* is fixed in such a manner that it is sandwiched by and between the tube portion 41 and calking ring 37, so that the shielding member 35 and shield shell 40 are conductively connected to each other. Also, due to the calking operation, on the outer periphery of the calking ring 37, there is formed a calking groove 38 extending in the peripheral direction thereof.

After completion of the calking operation, there is mounted the cover 50 in order to enclose the diameter-spread portion 35*a* of the shielding member 35. In mounting the cover 50, by deforming the cover 50 elastically in such a manner to spread a slit 56, the opening of the small-diameter portion 52 is spread provisionally and, in this state, the cover 50 is placed from the front side onto the three wire-side terminals 25, the end portions of the three wires 20, shield shell 40, the diameter-spread portion 35*a* of the shielding member 35, and the end portion of the corrugated tube 36 sequentially in this order.

When the cover 50 has passed through the flange portion 42 and mounting portions 43 of the shield shell 40, the cover 50 is returned back to its initial shape so as to close the slit 56; and, after then, the large-diameter-side engaging portion 54 of the cover 50 is engaged into the calking groove 38 and, at the same time, the small-diameter-side engaging portion 55 thereof is engaged with the uneven portions of the outer periphery of the end portion of the corrugated tube 36. Due to the engagement of the two engaging portions 54 and 55, the cover 50 can be united with the shield shell 40 and corrugated tube 36 as an integral body. In the state above, the large-diameter portion 51 of the cover 50 encloses the calked portion between the tube portion 41 of the shield shell 40 and the diameter-spread portion 35*a* of the shielding member 35, the taper portion 53 encloses the substantially rear half portion of the diameter-spread portion 35*a*, and the small-diameter portion 52 encloses the end portion of the corrugated tube 36. Also, the diameter-spread portion 35*a* of the shielding member 35 extends substantially along the inner periphery of the cover 50.

Incidentally, since the front end edge of the large-diameter portion 51 of the cover 50 is situated nearer to the inner peripheral side of the cover 50 than the protection wall 45 of the shield shell 40, there can be prevented from a foreign object can interfere with the front end portion of the cover 50 from outside.

Finally, in order to prevent the cover 50 from shifting from the corrugated tube 36, there is wound adhesive tape (not shown) spirally from the outer periphery of the small-diameter portion 52 of the cover 50 to and over the outer periphery of the corrugated tube 36. The adhesive tape may be preferably wound in such a manner that it covers the slit 56 over the entire length thereof. Also, in the case of the corrugated tube 36 as well, the adhesive tape may be preferably wound on the corrugated tube 36 over the entire length thereof so as to cover the slit formed on the corrugated tube 36.

The shielded wire harness 1 is assembled by the process described above. After then, the respective wire-side terminals 25 are inserted individually into their associated mounting holes 15 of the shield case 11. The equipment connecting portions 26 of the thus-inserted wire-side terminals 25 are placed on the equipment-side terminals 13 which wait for them within the shield case 11, while the bolt holes 14 and 27 are set so as to correspond to each other. And, in case where nuts 17 are screwed with their associated bolts 16 which have been penetrated through the bolts 14 and 27 and are then tightened together, the terminals 13 and 25 can be fixed in a swing restricting manner and can also be connected together in a conductible manner. Also, within the mounting hole 15, the contact between the inner periphery of the mounting hole 15 and the outer periphery of the outer covering 30 can be prevented by the sealing ring 32.

After connecting the terminals 13 and 25, the shield shell 40 is mounted to the shield case 11. In the mounting operation, in case where the bolt holes 44 of the shield shell 40 are set so as to correspond to the female screw holes of the shield case 11 and bolts (not shown) inserted into the bolt holes 44 are screwed with the female screw holes and are then tightened together, the shield shell 40 can be fixed to the shield case 11 as well as can be connected thereto in a conductible manner. As a result of this, the shielding member 35 is connected through the shield shell 40 to the shield case 11, thereby completing the assembly of the shielded wire harness 1 to the equipment 10.

As described above, in the shielded wire harness 1 according to the embodiment, while the shielding member 35 composed of braided wires is enclosed by the corrugated tube 36 and the end portion of the shielding member 35 is projected from the corrugated tube 36 and is spread in diameter, because the diameter-spread portion 35*a* of the shielding member 35 is covered with the cover 50, so that the diameter-spread portion 35*a* can be protected positively.

Also, since the cover 50 is made of rubber and thus can be elastically shifted, for example, when the shield shell 40 and the diameter-spread portion 35*a* of the shielding member 35 are temporarily moved to the corrugated tube 36 side in order to insert the wire-side terminals 25 into the mounting holes 15 of the shield case 11, it is not necessary to remove the cover 50 from the diameter-spread portion 35*a*.

Further, use of the rubber-made cover 50 can flexibly cope with even a case in which the wires 20 and diameter-spread portions 35*a* are bent with a small radius of curvature between the shield shell 40 and corrugated tube 36.

Also, while the cover 50 includes the large-diameter portion 51 corresponding to the shield shell 40 and the small-diameter portion 52 corresponding to the corrugated tube 36, since the cover 50 includes the slit 56 cut formed therein at and from the open end thereof on the small-diameter portion 52 side thereof, when, after the shield shell 40 is fixed to the diameter-spread portion 35*a* of the shielding member 35, these shield shell 40 and diameter-spread portion 35*a* are inserted into the cover 50, it is not necessary to spread the small-diameter portion 52 of the cover 50 forcibly against the elasticity thereof, thereby being able to provide good operation efficiency.

Further, the cover 50 is configured to have the large-diameter-side engaging portion 54 and small-diameter-side engaging portion 55, and these engaging portions 54, 55 are fitted with the calking groove 38 and the uneven portions of the outer periphery of the corrugated tube 36. Therefore, the cover 50 can be prevented from being removed from the corrugated tube 36 and shield shell 40.

The invention is not limited to the embodiment that have been described heretofore in the foregoing description and drawings, but, for example, the following embodiments also fall within the technical scope of the invention; and further, other changes and modifications than the following embodiments are also possible without departing from the scope of the appended claims.

(1) In the embodiment described above, the respective wire-side terminals are held by the outer coverings individually. However, according to the invention, two or more wire-side terminals may also be held collectively by a single outer covering.

(2) In the embodiment described above, the outer coverings that hold the wire-side terminals and shield shell are mounted on the shield case as separate parts. However, according to the invention, the outer coverings and shield shell may also be mounted onto the shield case in a state where they are connected together by connecting means or the like.

(3) In the embodiment described above, there is formed the slit on the cover. However, according to the invention, it is also possible to employ a cover in which no slit is formed.

(4) In the embodiment described above, the end portion of the cover is fitted with the outer surface of the corrugated tube. However, according to the invention, the end portion of the cover and the end portion of the corrugated tube may not be fitted with each other.

(5) In the embodiment described above, the end portion of the cover is fitted with the shield shell. However, according to the invention, the end portion of the cover and shield shell may not be fitted with each other.

(6) In the embodiment described above, the slit of the cover is formed so as not to reach the open edge of the cover on the large-diameter-portion side thereof and the large-diameter portion is formed as a tube-shaped portion which continues over the entire periphery thereof. However, according to the invention, the slit may also be formed so as to extend from the small-diameter-portion-side open edge up to the large-diameter-portion-side open edge. In the case configured as above, the cover can also keep its tube-like shape due to the elastically restoring force thereof. Also, by winding adhesive tape on the outer periphery of the cover, the cover can be prevented from spreading and deforming.

(7) In the embodiment described above, between the large-diameter and small-diameter portions of the cover, there is interposed the taper portion the diameter of which changes gradually. However, according to the invention, such taper portion may not be formed but the large-diameter and small-diameter portions may be formed continuously with each other in such a manner that the diameters of them are changed stepwise.

(8) In the embodiment described above, the terminal metal member and outer covering are united together into an integral body by molding. However, according to the invention, the terminal metal member may be inserted into a housing which has been previously formed.

According to the invention, the diameter-spread portion of the shielding member is covered with the cover so that it can be protected positively. Also, since the cover is made of rubber and thus it can be elastically shifted, when shield shell and the diameter-spread portion of the shielding member are provisionally moved to the corrugated tube, for example, in case where the wire-side terminals are inserted into the shield case, the cover may not be removed from the diameter-spread portion. Further, use of the rubber-made cover can cope with even a case in which the wires and diameter-spread portion are bent with a small radius of curvature.

According to the invention, the cover has a slit formed thereon that obtained by cutting the cover at and from the open edge on the small-diameter portion side. Therefore, after the shield shell is fixed to the diameter-spread portion of the shielding member, when inserting the shield shell and diameter-spread portion into the cover, there is no need to forcibly spread the small-diameter portion of the cover against the elastic force thereof.

According to the invention, the engaging portion of the cover is fitted with the corrugated tube or shield shell. Therefore, the cover can be prevented from being removed from the corrugated tube or shield shell.

Although the present invention has been shown and described with reference to a specific embodiment, various changes and modifications will be apparent to those skilled in the art from the teachings herein. Such changes and modifications as are obvious are deemed to come within the spirit, scope and contemplation of the invention as defined in the appended claims.

What is claimed is:

1. A shielded wire harness comprising:

a plurality of wires;

a plurality of wire-side terminals respectively connected to the plurality of wires and configured to be connected to respective terminals disposed within a shield case of an equipment;

a shielding member configured to enclose the plurality of wires collectively;

a protecting member configured to enclose the shielding member; and a shield shell configured to be connected to the shield case, wherein the shielding member comprises a diameter-spread portion in which a diameter thereof is spread larger than that of the protecting member at an end portion where the shielding member is projected from the protecting member, and connected to the shield shell at an end edge thereof, and the shielding member is made of braided wires formed by metal thin lines braided in a meshed manner, and the shielded wire harness further comprises a covering member formed in a tube shape and configured to cover the diameter-spread portion, the covering member including a large-diameter portion corresponding to the shield shell, a small-diameter portion corresponding to the protecting member, and a slit formed on the covering member from an opening end of the small-diameter portion on to the large-diameter portion and the covering member being made of elastic material.

2. The shielded wire harness as claimed in claim 1, wherein the shielding member is formed in a tube shape.

3. The shielded wire harness as claimed in claim 1, wherein the protecting member has a flexible characteristic.

4. The shielded wire harness as claimed in claim 3, wherein the protecting member is made of corrugated tube.

5. The shielded wire harness as claimed in claim 1, wherein the covering member is made of rubber.

6. The shielded wire harness as claimed in claim 1, wherein the covering member comprises an engaging portion configured to engage with at least one of the protecting member and the shield shell.

* * * * *